United States Patent [19]

Hollingsworth et al.

[11] Patent Number: 4,598,527

[45] Date of Patent: Jul. 8, 1986

[54] SKIN PACKAGING MACHINE WITH TEMPERATURE SENSING PROBE

[75] Inventors: Alexander Hollingsworth, Anderson; Stephen H. Jones, LaFrance, both of S.C.

[73] Assignee: Nordson Corporation, Amherst, Ohio

[21] Appl. No.: 662,366

[22] Filed: Oct. 18, 1984

[51] Int. Cl.[4] ..... B65B 11/52

[52] U.S. Cl. ..... 53/427; 53/509

[58] Field of Search ..... 53/75, 52, 373, 427, 53/500; 493/5; 34/48

[56] References Cited

U.S. PATENT DOCUMENTS

| | | | |
|---|---|---|---|
| 4,132,052 | 1/1979 | Larson | 53/75 |
| 4,326,342 | 4/1982 | Schregenberger | 34/48 X |
| 4,400,612 | 8/1983 | Lee | 53/509 X |
| 4,413,172 | 11/1983 | Jones | 53/509 X |
| 4,472,921 | 9/1984 | Jones | 53/509 X |
| 4,498,248 | 2/1985 | Pabst | 34/48 X |
| 4,498,864 | 2/1985 | Roth et al. | 34/48 X |

FOREIGN PATENT DOCUMENTS

| | | | |
|---|---|---|---|
| 0066941 | 12/1982 | European Pat. Off. | 53/509 |
| 2543763 | 4/1977 | Fed. Rep. of Germany | 34/48 |
| 2901974 | 7/1980 | Fed. Rep. of Germany | 34/48 |
| 2904274 | 8/1980 | Fed. Rep. of Germany | 34/48 |

*Primary Examiner*—John Sipos
*Assistant Examiner*—Steven P. Weihrouch
*Attorney, Agent, or Firm*—Wood, Herron & Evans

[57] ABSTRACT

A skin packaging machine having a vacuum box and an oven spaced above the vacuum box, a film frame movable between the vacuum box and the oven, and a probe mounted on the film frame, the probe being movable into and out of a position contacting the underside of a film supported on the film frame.

8 Claims, 4 Drawing Figures

SKIN PACKAGING MACHINE WITH TEMPERATURE SENSING PROBE

This invention relates to a skin packaging machine, and more particularly, to a method and apparatus for heating and cooling the film forming part of the skin package.

A skin packaging machine is an apparatus for drawing a heated film, by vacuum, down onto a substrate such as paperboard, the substrate having one or more articles to be packaged placed upon it. Conventionally, a skin packaging machine includes a vacuum box having a perforated platen forming a horizontal surface onto which the substrate is placed. An oven is spaced above the vacuum box. A film frame is movable between a position adjacent to the vacuum box and a position adjacent the oven. A film supply roll is located alongside the vacuum box.

The film is placed in the film frame when the frame is in a lowered position. The frame is then raised to bring the film into a position adjacent the oven where the film is heated until it becomes "droopy." Meanwhile, the operator places a substrate with the articles to be packaged on top of the vacuum box. The film frame is then lowered to bring the heated film into position overlying the substrate and articles. Simultaneously, the vacuum is drawn on the vacuum box to pull the film tightly down onto the substrate and around the article to be packaged. The film will adhesively join to the substrate thereby forming the package. The operator then slides the package off the vacuum box, this operation drawing a fresh supply of film into the film frame. The film is transversely severed adjacent the package and the sequence of operations is repeated.

An objective of the present invention has been to provide for the heating of the film in a way which is more energy and time efficient.

This objective of the invention is attained by providing a probe pivotally mounted on the film frame and movable by a cam between a position out of the way of the film and a position in contact with the undersurface of the film. The invention also includes a fan adapted to blow cooling air across the space between the oven and the vacuum box.

By providing for the pivoting of the probe, the probe is moved away from exposure to the oven when it is not in operative position, thereby enabling the probe to cool between cycles.

It has been known to mount a probe in a position to contact the upper surface of the film. Such a probe has two disadvantages of shading the film by the probe from the heat of the oven, thereby preventing a direct reading of the film temperature. Furthermore, the probe is not adapted to move out of the way of the oven and therefore does not have the opportunity to cool. With the present invention, the probe contacts the underside of the film, thereby obtaining a direct monitoring of the temperature of the film without any shading.

The combination of probe and cooling fans permits the film frame to be raised to an intermediate position spaced above the vacuum box and below the oven while the operator places a substrate on the article to be packaged on the vacuum box. During this time, the film is subjected to convection heat from the heat stored in the quartz tubes of the heating elements and the rest of the oven structure. In this position the probe is in contact with the film and directly measures its temperature. When the temperature rises to a point above which the film will tend to degrade, the cooling fans are automatically turned on to lower the temperature. When the temperature falls too low, preselected cooling fans are turned off to let the film temperature rise. Thus, there is permitted a preheating of the film without energizing the heating elements so that when the film is brought into position against the oven, the period for finally heating the film to the desired temperature is quite short.

The invention also includes a plurality of heating elements each of which consists of a quartz tube spirally wound with a nichrome heating ribbon and an outer quartz tube surrounding the heating ribbon. The heating elements, with the surrounding outer quartz tube, provide electrical insulation to avoid accidental contact of the heating element by the operator, thereby preventing shock or even electrocution. This structure in turn permits the quartz tubes to be mounted close to the oven opening so that the film can be brought within about ½" of the heating elements, thereby permitting rapid and efficient heating of the film.

The several features and objectives of the present invention will become more readily apparent from the following detailed description taken in conjunction with the accompanying drawings in which.

Figure 1:
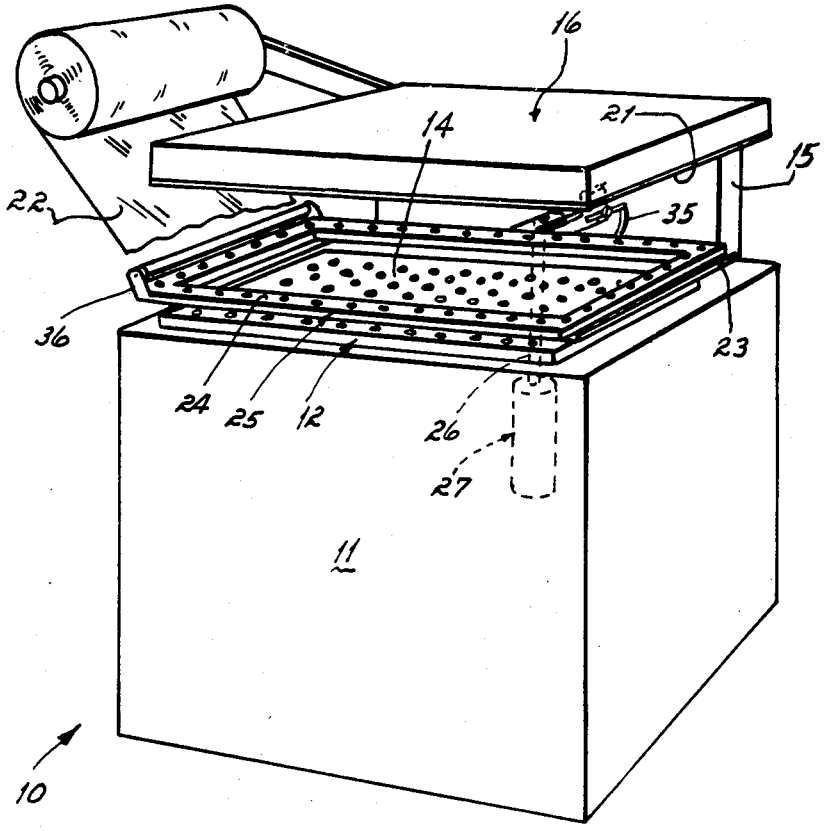
FIG. 1 is a perspective view of the skin packaging machine of the present invention.

The skin packaging machine is shown at 10 and includes a cabinet 11 which supports a vacuum box 12. The vacuum box has a perforated or foraminous surface 14 onto which a substrate and the article to be packaged is mounted. A source of vacuum, not shown, is connected to the vacuum box to draw heated film tightly against the substrate and article to secure the film to the substrate.

A power post 15 projects above the cabinet and the oven 16 is mounted on the power post.

An oven 16 is spaced above the vacuum box. The oven has a reflector 17 which is covered by layers of insulation 18 on its upper surface. The reflector supports a plurality of heating elements 20. Around the perimeter of the reflector is a gasket 21 engageable by a film frame, to be described below. The distance between the lower extremity of the heating elements and the lower surface of the gasket is about ½" so that when the film frame brings the film into contact with the gasket, the film will be spaced from the heating elements by only about ½".

A support for a supply of film 22 is mounted on the left side of the cabinet as viewed in FIG. 1. A film frame 25 is mounted between the vacuum box 12 and the oven 16. The film frame is hollow and has perforations in its upper surface 24. A hot knife 23 is mounted on the right side of the film frame as viewed in FIG. 1 for severing the film after a package has been formed. The film frame is connected to a separate vacuum source, the vacuum being used to hold the film onto the film frame. See my copending application Ser. No. 660,109, filed Oct. 12, 1984, for a detailed description of the film frame. The film frame is vertically slidable on ways, not shown. A piston 26 and cylinder 27 are connected between the cabinet 11 and film frame to cause the film frame to move from the vacuum box to an adjustable intermediate position between the vacuum box and oven and finally to a position wherein the film frame carries the film into engagement with the gasket 21 of the oven.

A pair of fans 28, each capable of delivering 100 cfm across the space between the vacuum box and oven, are mounted on the post. The fans are employed to maintain the film below a predetermined temperature when the film is in an intermediate preheat position. The fans are also used to cool the film on the substrate after the package has been formed.

Figure 2:
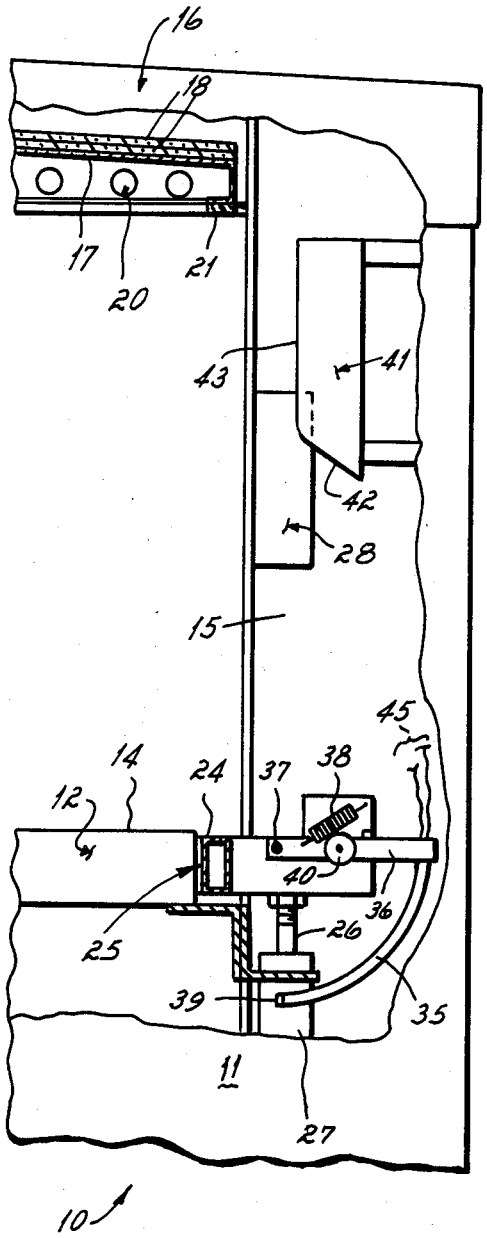
FIG. 2 is a fragmentary, side-elevational view showing the probe in an inoperative position.

A probe 35 is mounted on an arm 36, the arm being pivoted on an axis 37 to the film frame 25. A tension spring 38 urges the arm 36 to the horizontal position shown in FIG. 2 where the probe-sensing element 39, preferably a thermistor, is held out of the way of direct reflection of heat from the overhead oven.

Figure 3:
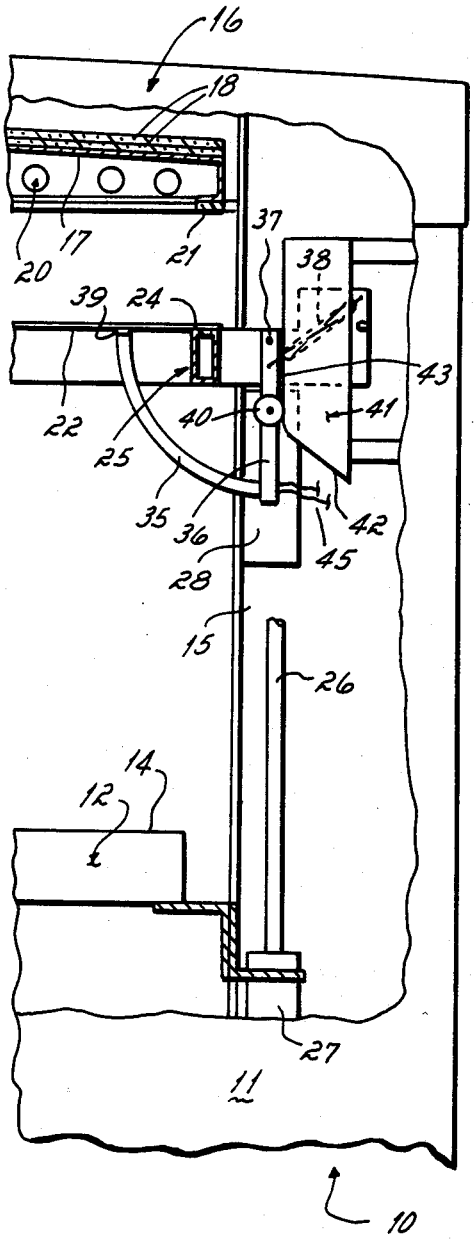
FIG. 3 is a view similar to FIG. 2 showing the probe in an operative position.

The probe carries a roller follower 40 which cooperates with a cam 41 having an inclined surface 42 and a vertical surface 43. When the film frame is raised to the intermediate position shown in FIG. 3, the follower 40 engages the surface 42 of the cam 41 causing the arm 36 to pivot counterclockwise as viewed in FIGS. 2 and 3 to the position shown in FIG. 3. As can be seen from FIG. 3, in this postion the probe sensor element 39 has been brought into direct contact with the undersurface of the film 22. As the film frame is raised to its uppermost position, bringing the film into contact with the gasket 21, the cam follower 40 is held in contact with the vertical surface 43, thereby maintaining the probe in the orientation of FIG. 3 in contact with the lower surface of the film. Instead of cam 31 & spring 38 a cammed slot configuration similar to surfaces 42 & 43 could be employed.

The probe has leads 45 which connect it to the machine controls so that the temperature of the probe can control the energization of the fans 28 and can control the downward movement of the film frame when the film has been raised to the predetermined temperature.

Figure 4:
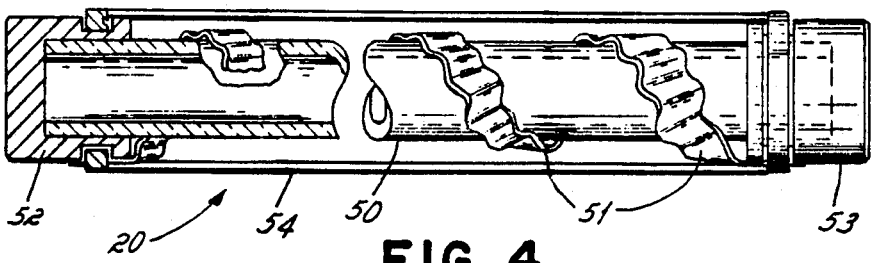
FIG. 4 is a cross-sectional view of a heating element.

The heating elements are shown in FIG. 4. Each heating element has an inner quartz tube 50 which is surrounding by a spirally wound ultra-thin nichrome ribbon 51. The ribbon is connected to terminals 52 and 53 at each end and by which it is connected to a voltage source, 220 volts, for example. An outer quartz tube 54, substantially transparent to radiant heat, surrounds the nichrome ribbon, thereby insulating it from the touch of the operator. The outer quartz tube also performs a heat sink function to retain heat which is used to preheat the film when it is held in an intermediate position on the film frame. See U.S. Pat. No. 3,621,200 for a description of the heating element without the outer quartz tube.

For the operation of the invention, let it be assumed a package has been formed and is pulled to the side of the film frame 25. The film frame is raised about ½" to 1" causing the hot knife 23 then energized to be raised against the film and to sever it from the package.

The film is then raised to an intermediate position above the vacuum box, permitting the operator to position a new substrate and one or more articles on the vacuum box. In moving to the intermediate position, the probe is cammed from the position of FIG. 2 to the position of FIG. 3 where its sensor element is in contact with the underside of the film. While the frame is in this intermediate position, residual heat of the oven, including the outer quartz tubes of the heating elements, begins to raise the temperature of the film. If the temperature of the film reaches a predetermined level, the control circuit will cause the fans to be turned on to blow cooling air across the film. If the cooling of the film lowers the temperature below a predetermined level, the probe signals the control circuit to turn off the fans so that the residual heat of the oven may once again raise the temperature of the film. Thus, the combination of the residual heat of the oven and the cooling fans raises the temperature of the film, but avoids such a high temperature of film that the film would sag and obstruct the operator's work in loading the vacuum box.

When the vacuum box is loaded with substrate and an article to be packaged, the operator pushes a button which starts the final sequence of operations. The film frame is raised until it seats on the gasket 21 surrounding the oven. Just prior to the frame being seated, the heating elements are energized to heat the film. The heating occurs rapidly because of the closeness of the heating elements and the seating of the film on the gasket 21. The probe moves with the frame and continues to monitor the temperature of the film. When the film reaches a preselected temperature and has begun to degrade to the extent that it sags significantly, the film frame is lowered to set it around the vacuum box and to bring the film on top of the substrate and article to be packaged. As the film frame is lowered, the cam follower 40 passes over the inclined surface 42 and the spring 38 swings the probe counterclockwise into an inoperative position. In this position, the probe is no longer subject to the oven radiation and, hence, the thermistor sensor cools to a level below the preselected temperature levels referred to above. Vacuum is applied to the vacuum box in a conventional manner to draw the film onto the substrate to cause it to adhere to the substrate. The cooling fan is then again turned on to cool the film sufficiently to complete the formation of the package. When the package is formed, it is slid off the vacuum box, thereby drawing fresh film onto the film frame and the cycle of operations is repeated.

Having described my invention, I claim:

1. In a skin packaging machine having a base, a vacuum box mounted on said base, an oven spaced above said vacuum box, means for mounting a supply of film adjacent said vacuum box, a post, a film frame mounted on said post for vertical movement between said vacuum box and said oven, a mechanism for regulating the temperature of film supported on said film frame comprising, a temperature probe having a sensing element, means for pivotally mounting said probe on said frame for movement between a first position wherein said sensing element contacts the undersurface of film on said frame and a second position in which said sensing element is remote from exposure to the oven, and means for swinging said probe to said first position as said frame is raised and for swinging said probe to a second position as said frame is lowered to a position adjacent said vacuum box.

2. Apparatus as in claim 1 in which said probe swinging means comprises;

a cam mounted on said post, a follower mounted on said probe and engageable with said cam, said cam being shaped to cause said probe to pivot between said two positions as said frame is raised and lowered.

3. Apparatus as in claim 1 further comprising, at least one fan mounted between said oven and said vacuum box to blow air across the space between said oven and said vacuum box, thereby enabling cooling of said film and the final package.

4. Apparatus as in claim 1 in which said oven includes as heating elements, a quartz tube, a thin nichrome ribbon spirally wound around said tube, and a quartz tube surrounding said nichrome ribbon.

5. Apparatus as in claim 4 in which said oven has a perimeter gasket having a surface engageable by said film frame, said gasket surface being spaced about one-half inch below said heating elements to enable rapid heating when said film frame is in engagement with said gasket.

6. Apparatus as in claim 1 further comprising, said frame having a low position adjacent said vacuum box for draping a hot film over an article to be packaged, said frame having a high position adjacent said oven for final heating of said film, said frame having an intermediate position spaced below said oven and above said vacuum box for preheating said film, said probe mounting means and said probe swinging means cooperating to maintain said sensing element in contact with said film in said high and intermediate positions of said frame.

7. Apparatus as in claim 6 in which said probe swinging means comprises, a cam mounted on said post, said cam having a lower inclined surface and an upper vertical surface, a follower mounted on said probe and engageable with said cam, said first surface, when engaged by said follower, upon upward movement of said frame swinging said probe to its first position as said frame reaches its intermediate position, said second surface maintaining said probe in its first position as said frame is raised to its high position, whereby said probe is brought to and maintained in an operative position with its sensing element in contact with film when said frame is in its intermediate and high positions.

8. In a skin packaging machine having a vacuum box, an oven spaced above said vacuum box, a film frame movable between said oven and said vacuum box, heating elements in said oven adapted to be fully energized when said film frame is adjacent said oven, a fan directing cooling air across the space between said oven and vacuum box, and a supply of film, the method of heating said film comprising the steps of, raising said film frame with film on it to an intermediate preheat position spaced from said vacuum box and said oven, continuously and directly monitoring the temperature of said film while said film is in said intermediate position and as said film is heated by residual heat from said oven and while said oven is not fully energized, intermittently operating and discontinuing operation of said fans while said film frame is in said intermediate position as the temperature rises above and lowers below a predetermined temperature, respectively, and raising said film frame against said oven for final heating of said film with said heating elements fully energized.

* * * * *